US005759084A

United States Patent [19]

Lecerf et al.

[11] Patent Number: 5,759,084

[45] Date of Patent: Jun. 2, 1998

[54] GRINDING MACHINE FOR OPHTHALMIC GLASSES

[75] Inventors: Michel Jean Marcel Lecerf; Raynald Gaston Marcel Longuet, both of Amfreville La Campane, France

[73] Assignee: Buchmann Optical Engineering, Ypres, Belgium

[21] Appl. No.: 540,210

[22] Filed: May 18, 1995

[51] Int. Cl.[6] ..... B24B 49/00; B24B 51/00

[52] U.S. Cl. ..... 451/5; 451/41

[58] Field of Search ..... 451/5, 11, 28, 451/43, 240, 144, 21, 41, 42

[56] References Cited

U.S. PATENT DOCUMENTS

| | | | |
|---|---|---|---|
| 1,226,329 | 5/1917 | Hansen | 451/240 |
| 1,455,863 | 5/1923 | Bugbee | 451/240 |
| 4,286,415 | 9/1981 | Loreto | 451/43 |
| 4,300,317 | 11/1981 | Croft et al. | 451/43 |
| 4,596,091 | 6/1986 | Daboudet et al. | 451/43 |
| 4,612,736 | 9/1986 | Massard et al. | 451/43 |
| 4,633,618 | 1/1987 | Kobayashi | 451/240 |
| 5,056,270 | 10/1991 | Curcher | 451/43 |
| 5,158,422 | 10/1992 | Wagner | 451/43 |
| 5,161,133 | 11/1992 | Lecerf et al. | 451/43 |
| 5,371,974 | 12/1994 | Lecerf et al. | 451/5 |
| 5,398,460 | 3/1995 | Joncour | 451/43 |
| 5,460,562 | 10/1995 | Lercere et al. | 451/5 |
| 5,549,503 | 8/1996 | Nauche et al. | 451/11 |

*Primary Examiner*—James G. Smith
*Assistant Examiner*—Derris H. Banks
*Attorney, Agent, or Firm*—Harrison & Egbert

[57] ABSTRACT

The invention is a grinding machine for ophthalmic glasses (14) of the type featuring a carriage (10) bearing a clamping axle in two parts (12A, 12B) between which a blank (14) of an ophthalmic glass is clamped and of the type equipped with a clamping device which axially acts upon at least one (12B) of the two parts (12A, 12B) of the clamping axle and features to that effect at least one geared motor (60, 66) and motor motive power transmission components (54, 28) which cause an axial translation of said part (12B) of the clamping axle, characterized by the fact that one (54) of the transmission components (28, 54) slides in relation to the carriage (10) in a direction parallel to the clamping axle against which (10) it rests axially with a reaction spring (80) mounted in between, and by the fact that a control unit is provided to vary the motor (66) motive power, and thus the axial clamping force on the blank (14) as a function of the elastic deformation of the spring (80).

6 Claims, 3 Drawing Sheets

GRINDING MACHINE FOR OPHTHALMIC GLASSES

This invention concerns a grinding machine for ophthalmic glasses.

The invention concerns more specifically a grinding machine for ophthalmic glasses, equipped with a device controlling the clamping force applied on the glass blank to be ground.

BACKGROUND ART

The invention finds an application, for example, in grinding machines for ophthalmic glasses of the type consisting of a frame, a carriage, for example in a general U shape, mounted on a first shaft so as to swing in relation to the frame, a second shaft parallel to the first shaft and featuring at least one wheel rotated by an electric motor; the carriage featuring a clamping axle, parallel to the first shaft, made out of two parts between which a blank of the glass to be ground is held and also driven through rotation for grinding operations.

For that purpose, the machine is equipped with a clamping device which axially acts upon at least one part of the clamping axle and features to that effect at least one geared motor and the motor motive power transmission components, generally arranged in a casing.

The geared motor outlet can for example be connected to a pinion driving a rack formed on a clamping rod which acts axially upon one of the two parts of the clamping axle.

The glass blank is clamped by energizing the electric motor of the geared motor so that it can supply motive power, i.e., a driving torque, which is converted into an axial clamping force by the geared motor and the rack and pinion device.

It can be noted that with the use of the machine and the wear and tear of its components, the efficiency of the geared motor and rack and pinion assembly varies, with the variations resulting from the clamping effort rather significant, for example at approx. 30%.

In grinding machines for ophthalmic glasses of known designs, it is thus not possible to control in a reliable and lasting manner the value of the clamping force applied on the glass blank to be ground.

It is possible to measure the clamping drive motor supply power, but this value does not reflect directly the clamping force as all mechanical components placed between the motor outlet shaft and the glass blank clamping shaft induce some friction which varies based on the wear of the machine, on the temperature and on the frequency of the clamping operations.

In French patent application No. 93 02810, a grinding machine of the above-mentioned type has already been proposed, which features a clamping value control device for the glass blank to be ground, in which the motor motive power transmission components are arranged, in a casing mounted in such manner that it swings in relation to the carriage; said casing being connected to the carriage through a reaction spring, and a control unit being provided to make the motor motive power vary in relation to the variation of the spring length.

However, although this patent application represents a significant improvement, this design does not permit to control in a reliable and lasting manner the value of the clamping force applied on the glass blank to be ground.

SUMMARY OF THE INVENTION

In order to eliminate these disadvantages, the invention proposes a grinding machine of the above-mentioned type, in which the motor motive power transmission components cause an axial translation of one of the clamping axle parts, and characterized by the fact that one of the transmission components slides in relation to the carriage in a direction parallel to the clamping axle against which it rests with a reaction spring in between, and by the fact that a control unit is provided to vary the motor motive power, and thus the axial clamping force on the blank as a function of the elastic deformation of the spring.

Under other specifications of the invention:

- the machine includes a spring deformation measurement sensor which transmits to the control unit a signal representative of the reaction force applied to the spring by said transmission component.
- said transmission component is mounted near one end of one of the two clamping axle parts, opposite to the blank;
- the transmission component is a nut screwed onto one of the clamping axle parts;
- a coaxial reaction bushing is placed between a radial face of the driving nut and the reaction spring;
- the reaction bushing is stopped trough rotation in relation to the carriage and features device to stop through rotation the threaded portion of the clamping axle;
- a bearing is placed between the radial face of the driving nut and an opposite radial face of the reaction bushing;
- the reaction spring is a blade subject to elastic deformation with one end attached to the carriage and the other free end working together with said transmission component;
- under another embodiment, said transmission component is a pinion driving a rack formed on one part of the clamping axle, mounted in a casing which slides in relation to the carriage and rests against the reaction spring.

BRIEF DESCRIPTION OF THE INVENTION

DETAILED DESCRIPTION OF THE INVENTION

Figure 1:
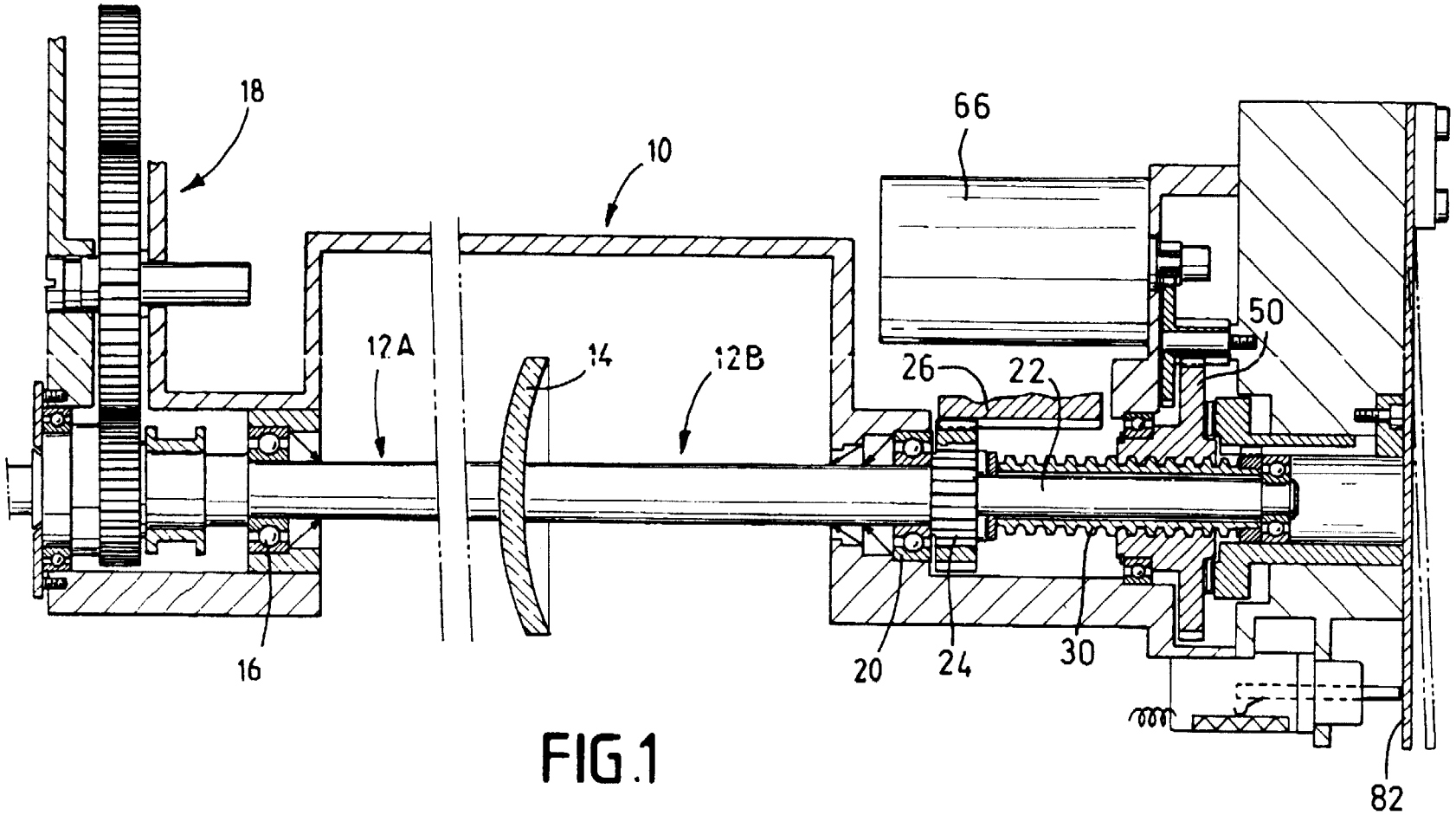
FIG. 1 is a schematic sectional side view of an opthalmic glass clamping device integral with the carriage of a glass grinding machine, made according to the teachings of this invention.

FIG. 1 represents a portion of carriage 10 of an ophthalmic glass grinding machine of a known design, featuring a clamping axle made of two parts 12A and 12B between which a blank 14 of a glass to be ground is being held.

The left part 12A of the clamping axle is mounted through rotation in carriage 10 with a bearing 16 in between and said part extends so as to be connected in rotation to a pinion assembly 18.

The right part 12B of the clamping axle also mounted through rotation in carriage 10 through a bearing 20 in which said part can also slide axially.

Figure 2:
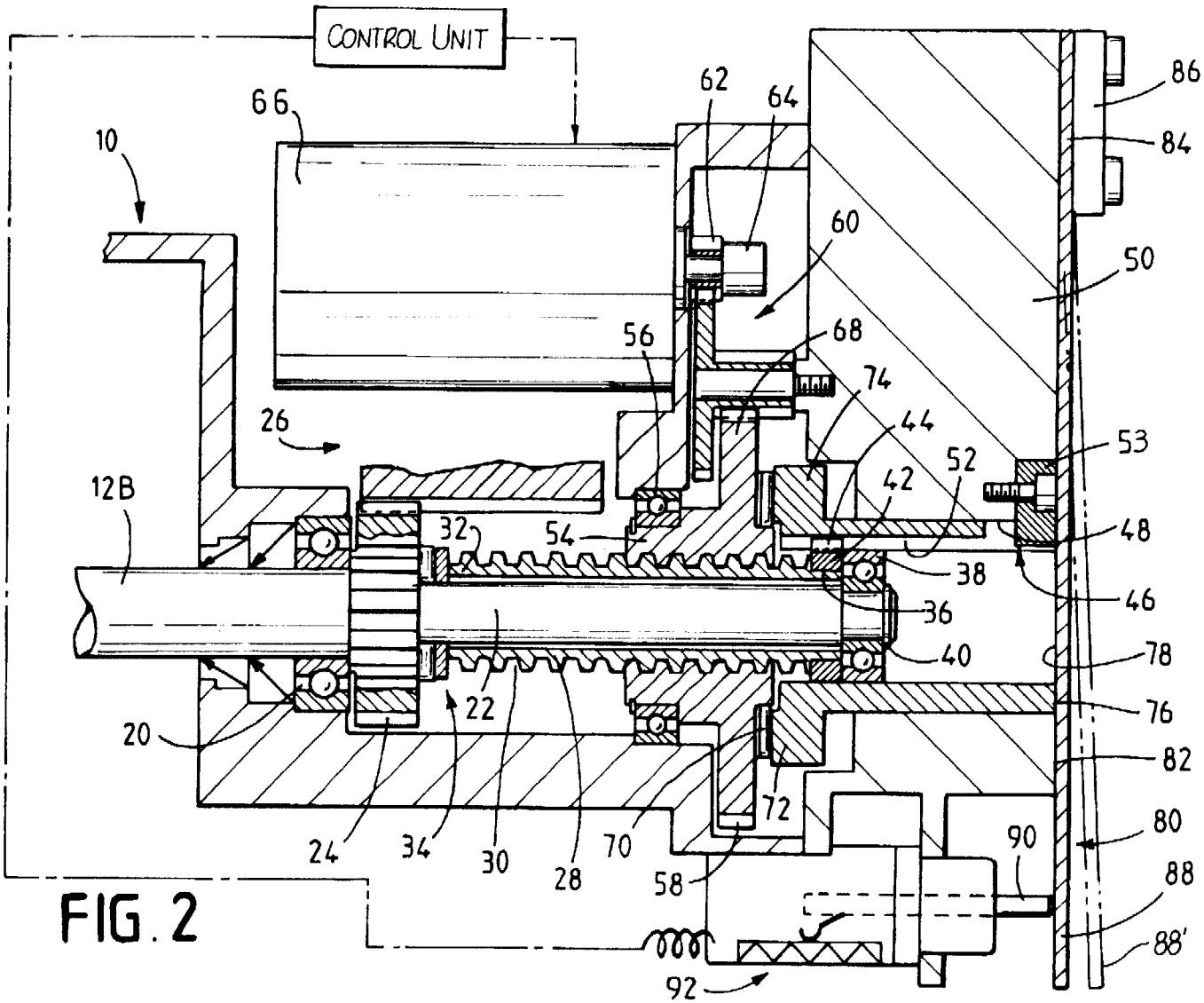
FIG. 2 is a partial sectional view, at a larger scale, of the right portion of FIG. 1.

Part 12B of the clamping axle extends axially to the right looking at FIGS. 1 and 2, through an end piece 22 onto which is connected trough rotation a rotary driving pinion 24 which is part of a pinion cascade 26.

The end piece 22 of the clamping half-axle 12B is also equipped with a sleeve 28 whose outside surface features thread 30.

An axial end 32 of sleeve 28 rests axially against pinion 24 with a thrust bearing 34 placed in between so as to be able to cause an axial movement —from right to left looking at FIG. 2 — of the clamping half-axle 12B.

The other end 36 of sleeve 28 rests against the opposite radial face of a bearing 38 which is axially immobilized on the end portion 22 through an elastic ring 40.

A ring 42 radially extending to the outside through a finger 44 is connected through rotation to sleeve 28.

Bearing 38 slides in a reaction bushing 46 itself sliding in a bore 48 made in a solid portion of carriage 1.

The reaction bushing 46 features an axial groove 52 receiving the finger 44 of ring 42 connected through rotation to sleeve 28.

The reaction bushing 46 is itself locked through rotation in relation tb part 50 of carriage 10 through a key 54 which is held with a sliding motion in groove 52.

The screw-type sleeve 28 bears a driving nut 54 mounted in rotation through a bearing 56 into carriage 10.

The driving nut 54 features a toothed wheel 58 driven through rotation by a pinion cascade 60 with one pinion 62 connected through rotation to the outlet shaft 64 of an electric motor 66.

A radial face 68 of the driving nut 54 rests against an opposite radial face 70 formed on a radial shoulder 72 of reaction bushing 46, with a thrust bearing 74 placed in between.

The driving nut 54 thus gets its reaction.to cause the axial translation displacement of the screw-type sleeve 28 against the reaction bushing 46.

The annular end radial face 76 of reaction bushing 46 can axially protrude out of bore 48 to rest against an opposite face 78 of a reaction spring 80 which consists of a sheet metal blade subject to elastic deformation 82 with one end of said blade attached to part 50 of carriage 10 through a clamp 86.

The lower free end 88 of the reaction spring consisting of the blade 82 works together with rod 90 which slides axially in a direction parallel to the clamping axle, and of a position sensor 92, for example, of the rheostat type.

Sensor 92, together with electric motor 66, are connected to a clamping control and clamping force adjusting unit, not represented, which changes the motor supply parameters to change the clamping force value based on the deformation of the reaction spring 80 measured by sensor 90.

Whenever motor 66 is energized, it causes the clamping of blank 14 through nut 54 which causes an axial movement —from right to left looking at the figures —of screw 28 and thus of clamping half-axle 12B.

During this clamping action, the radial face 68 of driving nut 54 rests against reaction bushing 46 which causes a deformation of spring 80, up to for example its deformed position 88' shown as a chain-dotted line in on FIG. 2.

This deformation, measured by sensor 92, enables to change the clamping power up to a perfectly controlled value.

The invention just described is not limited to the embodiment shown on the figures.

The reaction spring and the spring measurement device can take on several forms; the spring can for example consist of a helical spring, a stack of spring washers, etc. . .

The invention is not limited either to the axial Driving system of the clamping half-axle 12B which is of the nut and screw type.

Figure 4:
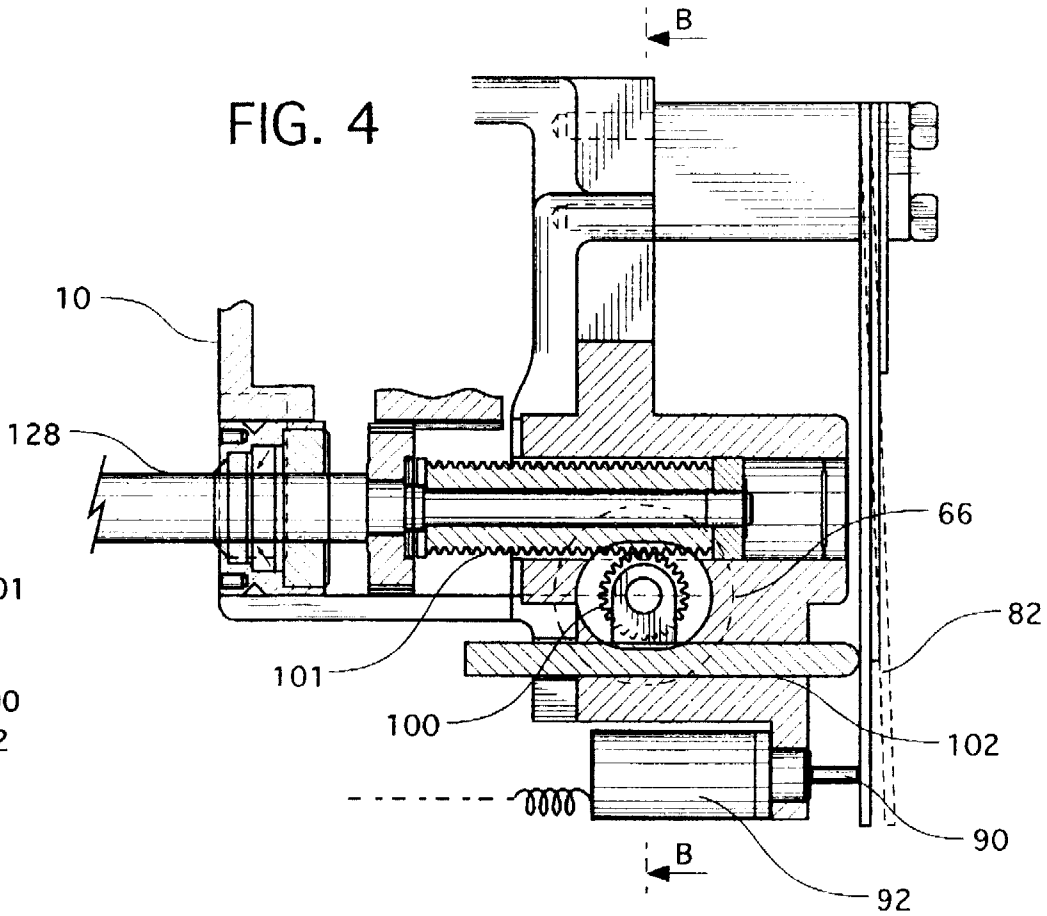
FIG. 4 is a cross-sectional view of the grinding machine as taken across lines A—A of FIG. 3.
Figure 3:
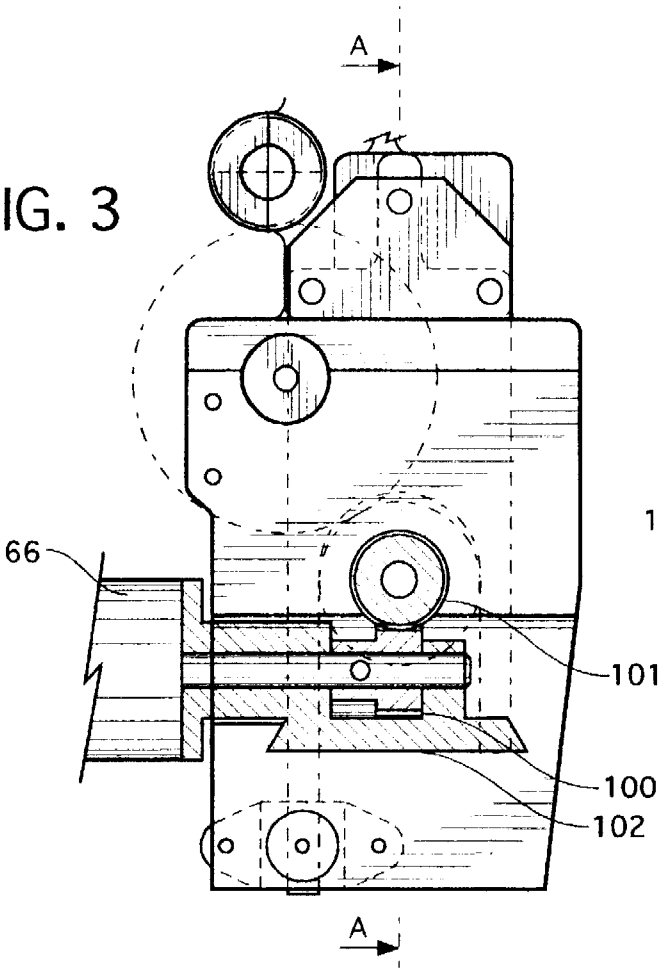
FIG. 3 is a cross-sectional view of the grinding machine as taken across lines B—B of FIG. 4.

As shown in FIGS. 3 and 4, and as in the case of French patent application No. 93 02810, the drive can for example be of the rack and pinion type on the clamping half-axle 12B, with the pinion and eventually all geared motor components mounted in a casing which can slide in relation to carriage 10 and rests against a reaction spring with a deformation representative of the clamping force.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

We claim:

1. A grinding machine for ophthalmic glasses comprising:

a carriage bearing a clamping axle in two parts between which parts a blank of an ophthalmic glass can be clamped; and a clamping means for axially acting upon at least a first one of said two parts, said clamping means comprising:

a geared motor;

a motor power transmission means operatively interposed between said geared motor and said first part, said motor power transmission means for causing an axial translation of said first part of said clamping axle upon actuation of said geared motor, said motor power transmission means mounted on said carriage for slidable movement relative to said carriage in a direction parallel to said clamping axle, said motor power transmission means bearing axially against said carriage through an interposed reaction spring, said reaction spring being elastically deformed as a direct function of an axial displacement of said motor power transmission means; and a control means connected to said geared motor for varying a power of said geared motor so as to control a resulting axial clamping force on the blank as a function of the elastic deformation of said reaction spring, said motor power transmission means is a driving nut screwed onto a thread of one of the two parts of the clamping axle.

2. The grinding machine according to claim 1 wherein a coaxial reaction bushing is placed between a radial face of the driving nut and the reaction spring.

3. The grinding machine according to claim 2 wherein the reaction bushing is stopped through rotation in relation to the carriage and has means for stopping through rotation of the clamping axle.

4. The grinding machine according to claim 3, wherein a bearing is placed between the radial face of the driving nut and an opposite radial face of the reaction bushing.

5. The grinding machine according to claim 2 wherein a bearing is placed between the radial face of the driving nut and an opposite radial face of the reaction bushing.

6. A grinding machine for ophthalmic glasses comprising:

a carriage bearing a clamping axle in two parts between which parts a blank of an ophthalmic glass can be clamped; and a clamping means for axially acting upon at least a first one of said two parts, said clamping means comprising:

a geared motor;

a motor power transmission means operatively interposed between said geared motor and said first part, said motor power transmission means for causing an axial translation of said first part of said clamping axle upon actuation of said geared motor, said motor power transmission means mounted on said carriage for slidable movement relative to said carriage in a direction parallel to said clamping axle, said motor power transmission means bearing axially against said carriage through an interposed reaction spring, said reaction spring being elastically deformed as a direct function of an axial displacement of said motor power transmission means; and a control means connected to said geared motor for varying a power of said geared motor so as to control a resulting axial clamping force on the blank as a function of the elastic deformation of said reaction spring, wherein the spring is a blade subject to elastic deformation with one end attached to the carriage and the other free end working together with said motor power transmission means.

* * * * *